United States Patent [19]

Jakob

[11] 4,193,636

[45] Mar. 18, 1980

[54] ASPHALT PAVING PLANER WITH CONVEYOR FORWARDLY OF CUTTING DRUM

[76] Inventor: Herbert E. Jakob, 8 Pritchard La., Taylors, S.C. 29687

[21] Appl. No.: 922,962

[22] Filed: Jul. 10, 1978

[51] Int. Cl.[2] ..... E01C 23/09

[52] U.S. Cl. ..... 299/39; 37/190; 299/89

[58] Field of Search ..... 299/39, 76, 78, 89; 37/108 R, 190; 198/304, 508, 300, 317, 318

[56] References Cited

U.S. PATENT DOCUMENTS

| | | | |
|---|---|---|---|
| 1,677,824 | 7/1928 | Harrison et al. | 37/190 |
| 2,508,080 | 5/1950 | Stumpf | 37/108 R |
| 2,612,361 | 9/1952 | Hagenbook | 299/76 X |
| 3,606,468 | 9/1971 | Walker et al. | 299/39 |
| 3,829,161 | 8/1974 | Wirtgen | 299/39 |
| 4,074,447 | 2/1978 | Shivers et al. | 299/39 X |

FOREIGN PATENT DOCUMENTS

| | | | |
|---|---|---|---|
| 809260 | 2/1937 | France | 37/190 |

*Primary Examiner*—Ernest R. Purser
*Attorney, Agent, or Firm*—Bailey, Dority & Flint

[57] ABSTRACT

An asphalt paving planer is illustrated wherein a power operated conveyor is mounted ahead of a cutter drum for receiving asphalt cuttings and conveying them to a truck and the like driving in the forward direction in front of the paver, and wherein a cutter drum drive is provided which includes an internal combustion engine for driving a V-belt drive which, in turn, drives a gear reducer carried adjacent the cutter drum.

6 Claims, 3 Drawing Figures

ASPHALT PAVING PLANER WITH CONVEYOR FORWARDLY OF CUTTING DRUM

BACKGROUND OF THE INVENTION

This invention relates to asphalt paving planers wherein a rotatable drum is employed having cutting elements spaced thereabout in a V-spaced pattern in such a manner to cause the cuttings to move from outer portions of the drum toward the center. U.S. Pat. No. 3,606,468 is illustrative of such a drum structure, but a reduction gear of a very elaborate type is necessitated for driving same. Moreover, the device illustrated in this patent has the added disadvantage of a conveyor which delivers the cuttings rearwardly of the planing apparatus necessitating the dump truck or other vehicle receiving the cuttings to be backed up behind the planning apparatus and to be backed up during the entire planing operation of the apparatus. This causes the cuttings to be dropped on the surface which has already been planed requiring a further expensive cleanup operation. Another example of a device employing drum cutters is illustrated in U.S. Pat. No. 3,829,161 which illustrates an apparatus wherein the roller is rotated in a direction opposite to the direction of forward movement of the roller with respect to the road surface.

While prior art machines have generally been able to cut the roadlike surface, the problem of efficiently gathering the cuttings from the cutting drum and loading them into a truck has remained unsolved. The power transmission means from the machine mounted engine to the cylindrical cutting drum has also been a source of many problems on previous machines because the hardness and the variations in hardness of the material being cut, and the variations in the depth of cut tend to create vibrations and shock loads in this power transmission application. The hydraulic transmissions, the gear transmissions and the chain transmissions have all encountered a high incidence of failure due to fatigue and momentary overloads when the cutting drum engaged metal objects such as drainage structures in roadways.

An important object of the invention, therefore, is to provide a machine in which the combination of a vertically slideable scraper blade behind the cylindrical cutter gathers the cut material and cleans the newly cut surface, and an inclined belt conveyor in front of the cutter on which the charging end is close to the cutter and above the material to be cut and on which the discharge end is elevated high enough above the roadlike surface to allow the cut material to be discharged into a truck traveling ahead of and in the same direction as the machine.

The cutter drum which has a large enough diameter and turns at a sufficient speed to eject the cut material onto the charging end of the conveyor is driven through a transmission that can be disengaged by means of a clutch on the engine. The transmission consists of a V-belt drive from the engine-mounted drive shaft to the gear reduction unit mounted in one end of the cylindrical cutter drum. By the use of the V-belt drive, the shock loads encountered by the cutting action of the cylindrical cutting drum are absorbed by the elastic quality of the belts and overload protection is provided in the transmission by the ability of the V-belt drive to slip when an object that cannot be cut is encountered.

Accordingly, it is an important object of this invention to provide for more efficient collection of asphalt cuttings and the like removed by a road planer.

Another important object of this invention is to provide for more efficient removal of cuttings by providing a more efficient drive which is capable of delivering high power from an internal combustion engine operated at high speed, but which will avoid damage thereto as when the cutting drum hits an obstacle as it often does, such as a manhole.

Since the cuttings are more efficiently removed, the reclaimation process is more efficient in that more asphalt is recovered through an efficient, inexpensive device operated with greater efficiency and less downtime.

BRIEF DESCRIPTION OF THE INVENTION

It has been found that an asphalt paving planer may be provided wherein a conveyor may be carried forwardly of a cutting drum from having a charging point for receiving cuttings ahead of the drum and for delivering the cuttings to a truck moving forwardly in front of the planer apparatus. A drive may be provided for the cutter drum employing V-belts and a gear box for delivering horsepower from the high speed internal combustion engine at a considerably lower speed to the other drum in such a fashion as to avoid damage as when the cutter drum encounters an obstacle in the roadway.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a wheeled apparatus including a chassis for removing a thickness of asphalt paving and the like drivable in a forward direction. A drum A has spaced cutting elements thereon rotatably carried by the chassis. Means carried by the chassis for driving the drum include a V-belt drive B from a power takeoff, an internal combustion engine and a gear reducer adjacent the drum. A power operated conveyor D has a charging point ahead of the drum in alignment therewith and adjacent thereto for receiving asphalt cuttings from the drum and the cutting elements carried thereby. Means E carries the conveyor so as to extend upwardly and forwardly from the drum so as to discharge the cuttings into a truck moving forwardly in front of the wheeled apparatus. A vertically adjustable scraper means F is carried adjacent the drum on a side of the drum opposite the conveyor.

Figure 1:
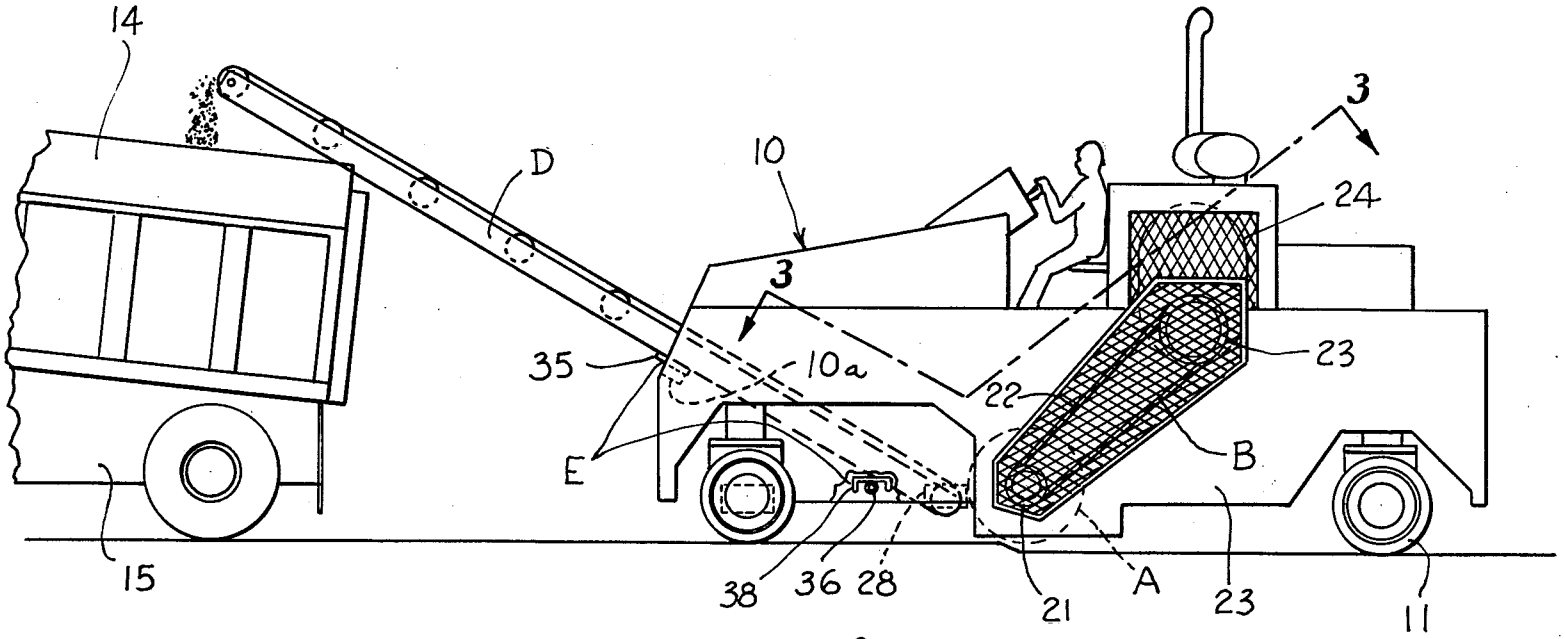
FIG. 1 is a side elevation illustrating an asphalt paving planer apparatus constructed in accordance with the present invention having a conveyor extending forwardly carrying cuttings into a dump truck driven forwardly of the apparatus.
Figure 3:
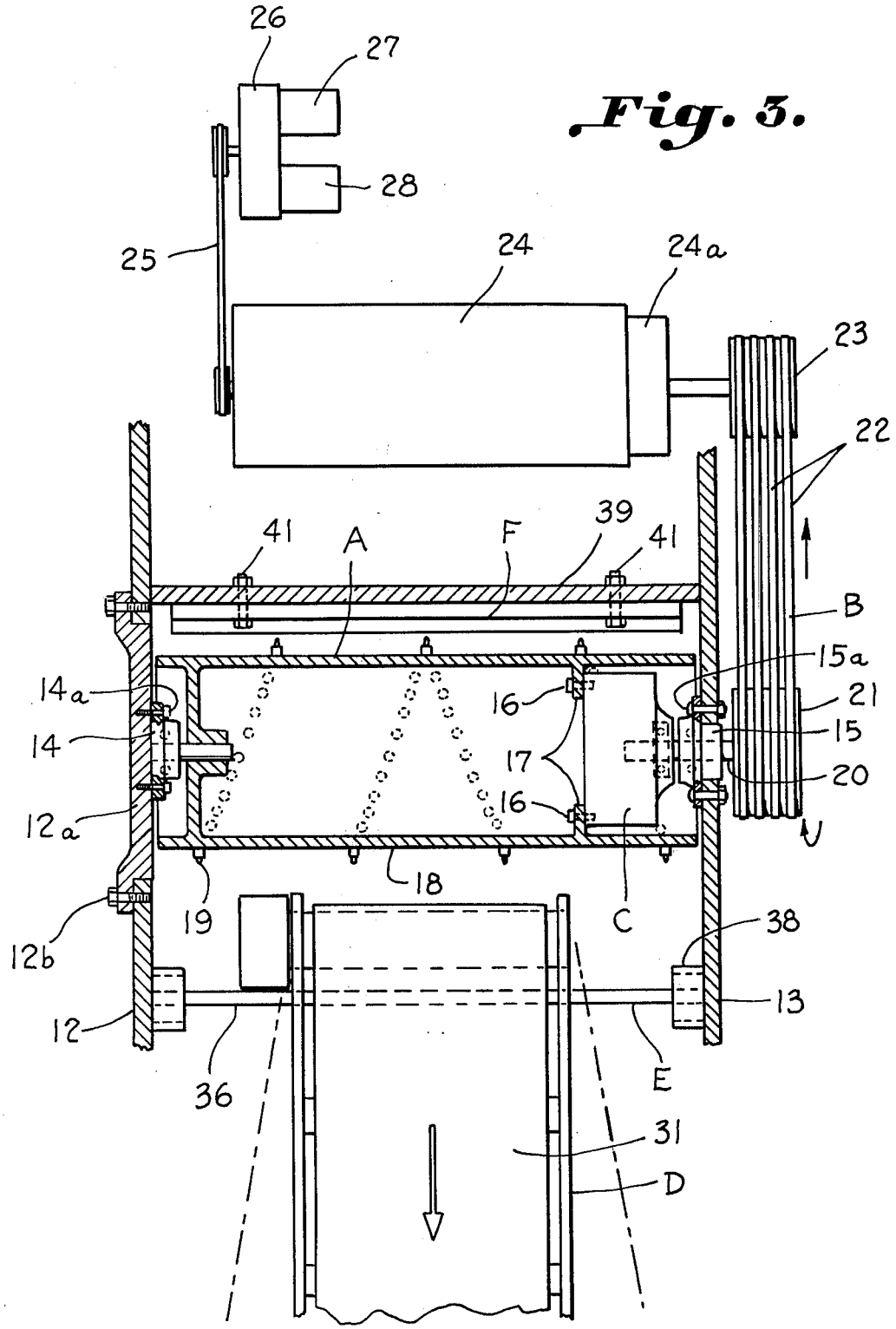
FIG. 3 is a sectional plan view taken substantially on the line 2—2 in FIG. 1.

FIG. 1 illustrates an asphalt planer which includes a wheeled apparatus having a frame broadly designated at 10, carried by wheels 11. The frame 10 includes side frame members 12 and 13 (FIG. 3). The conveyor is illustrated in FIG. 1 as transmitting cuttings into the dump body 14 of a dump truck 15 which is moving forwardly in front of the asphalt paving planer apparatus which is moving forwardly. The cutter drum A is carried for rotation between the side frame members 12 and 13 upon suitable bearings 14 and 15. The bearing 14 has fixed connection as by bolts 14*a* upon a removable section 12*a* of the frame 12. The removable section 12*a* is secured by bolts 12*b* to the frame 12. The bearing 15 is fixed as by bolts 15*a* upon the frame 13 and a gear reducer C which turns with respect to the bearing 15 is fixedly carried as by bolts 16 within support members 17 extending within the outer shell 18 of the drum A.

Figure 2:
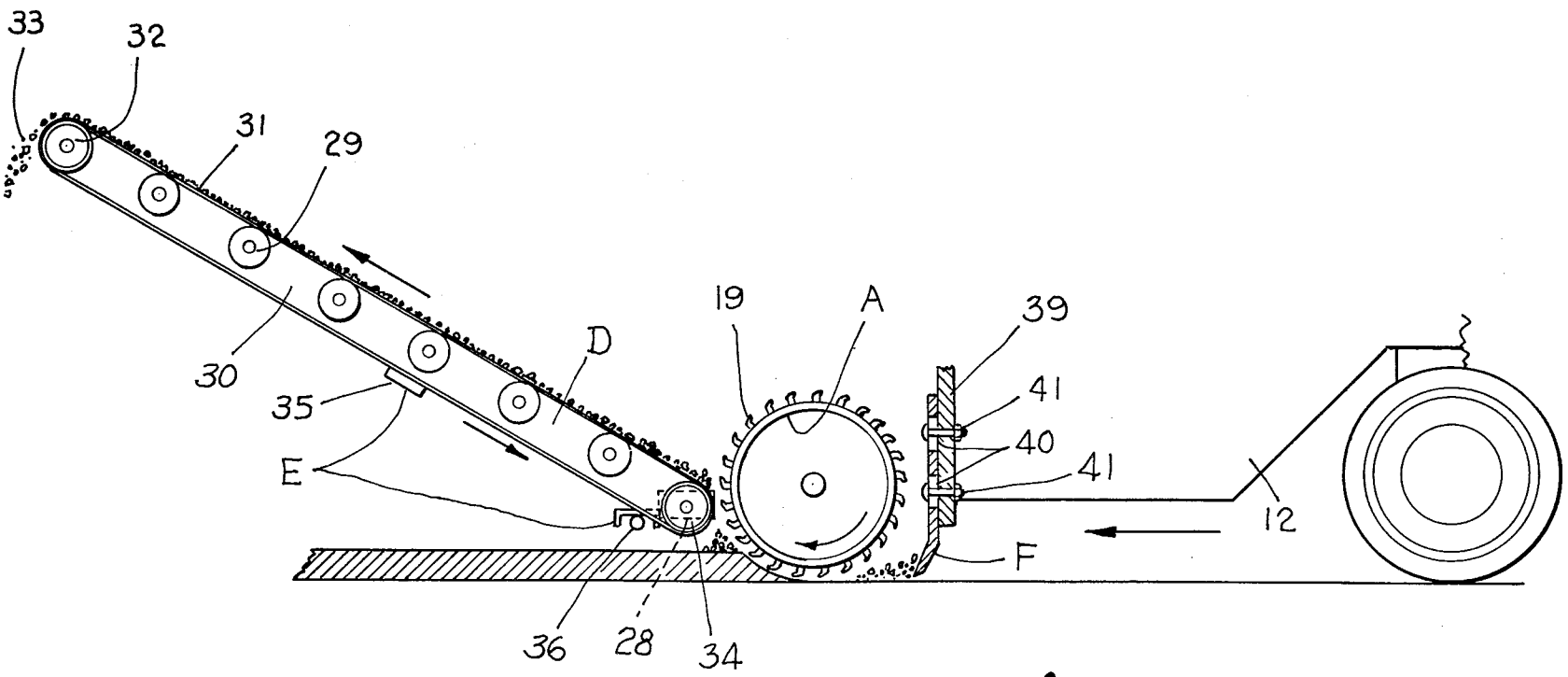
FIG. 2 is a transverse, sectional elevation illustrating the conveyor and cutter drum arrangement of FIG. 1 in greater detail.

The drum A carries cutting means or cutting elements 19 in rows which converge inwardly in helical fashion starting at both ends of the drum forming a substantial V-shape in the middle for moving the cuttings from the outer edges of the drum towards the middle for reception by the conveyor. The bearing 15 carries a shaft 20 from the power takeoff mechanism C which carries a pulley 21 for receiving power from multiple V-belts 22, which are driven by the pulley 23 from a suitable internal combustion engine 24 through a clutch 24*a*. The internal combustion engine illustrated herein may be a diesel engine delivering high speed but relatively low torque to the pulley 23. The motor 24, through a suitable drive 25, drives the gear box 26 for supplying power to a hydraulic pump 27 for driving the wheels 11 of the asphalt paving planer apparatus. A hydraulic pump 28 is also driven to supply power to the conveyor and controls. A suitable conveyor D has rollers 29 carried by frame members 30. The rollers carry a driven belt 31 about a roller 32 at the top for delivering cuttings 33 (FIG. 2) to the dump body 14. It is important that the conveyor present a charging point ahead of the drum A and this is accomplished by positioning the lower drum 34 of the conveyor approximately on the same level or perhaps slightly below the center line of the drum. The lower drum 34 of the conveyor should be slightly above the surface to be planed and conveniently be about 3" to 5" of surface for removal. Preferably, the drum turns in the direction of the arrow in FIG. 2.

The conveyor is mounted similarly below its center of gravity upon a transverse support 10*a* of the vehicle 10. The means E further includes a plate 35 which may slide transversely upon the support 10*a*. A transverse bar 36 is carried by the frame members 30 of the conveyor D for reception within spaced channel shaped members 38 carried by respective frame members 12 and 13. Thus, a mounting is provided for the lower end of the conveyor D since the bar 36 is limited in its upward as well as lateral movement within the channel shaped members 38. The conveyor D may thus be moved from side to side, as well as in the direction of the broken lines in FIG. 3 for the convenience of the operators.

A vertical scraper blade F is provided and spaced rearwardly of the drum A and carried by a support 39 mounted between the side frame members 12 and 13. The scraper blade has spaced vertical slots 40 for receiving fastening means in the form of bolts 41 to permit vertical adjustment thereof. The scraper blade maintains the cuttings adjacent the drum for positioning at all times upon the conveyor.

It is thus seen that a more efficient reclaimation process may be carried out for the asphalt cuttings since they are all positively delivered to a conveyor and may be conveniently carried forwardly to a vehicle which is also driven forwardly in front of the asphalt planer hereof. A vastly simplified and more inexpensive and efficient drive has been provided for increasing the efficiency of the cutting operation while minimizing downtime, as for repairs.

While a preferred embodiment of the invention has been described using specific terms, such description is for illustrative purposes only, and it is to be understood that changes and variations may be made without departing from the spirit or scope of the following claims.

What is claimed is:

1. A self-propelled wheeled apparatus including a chassis for removing a thickness of asphalt paving and the like drivable in a forward direction comprising:

a drum having spaced cutting elements thereon rotatably carried by said chassis extending below and in longitudinal alignment therewith;

means carried by said chassis for driving said drum;

a power operated conveyor having a charging point ahead of said drum in alignment therewith and adjacent thereto for receiving asphalt cuttings from said drum and the cutting elements carried thereby;

means carrying said conveyor so as to extend upwardly and forwardly from said drum so as to discharge said cuttings into a truck moving forwardly in front of said wheeled apparatus; and a vertically adjustable scraper means carried adjacent said drum on a side of said drum opposite said conveyor.

2. The structure set forth in claim 1 wherein means for driving said drum includes an internal combustion engine, a V-belt driven by said engine; and a gear reducer driven by said V-belt mounted in said drum.

3. The structure set forth in claims 1, or 2 wherein said means carrying said conveyor includes a connection adjacent a lower end of said conveyor permitting limited vertical and lateral movement, and means mounting the conveyor on said apparatus below its center of gravity.

4. A wheeled asphalt planer comprising:

a frame;

an internal combustion engine carried by an upper portion of said frame;

a hollow cylindrical drum carried for rotation transversely of said frame below said motor;

asphalt cutting elements spaced about said drum;

a gear reducer mounted within said drum driving said drum;

a V-belt drive transmitting power from said engine to said gear reducer; and a conveyor extending upwardly and forwardly of said drum in longitudinal alignment therewith for delivering material removed by said cutting elements to a vehicle driven forwardly of said planer.

5. The structure set forth in claim 4 including a scraper blade carried rearwardly of said drum.

6. The structure set forth in claim 5 including means mounting said conveyor for lateral adjustment with the lower end in substantial alignment with said drum.

* * * * *